US009474371B2

(12) United States Patent
Lee et al.

(10) Patent No.: US 9,474,371 B2
(45) Date of Patent: Oct. 25, 2016

(54) LAUNDRY TREATMENT APPARATUS

(71) Applicant: LG ELECTRONICS INC., Seoul (KR)

(72) Inventors: Hyunsoo Lee, Seoul (KR); Taehyeon Sim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/515,887

(22) Filed: Oct. 16, 2014

(65) Prior Publication Data

US 2015/0130338 A1 May 14, 2015

Related U.S. Application Data

(60) Provisional application No. 61/892,046, filed on Oct. 17, 2013.

(30) Foreign Application Priority Data

Oct. 1, 2014 (KR) ..... 10-2014-0132639

(51) Int. Cl.
*A47L 15/42* (2006.01)
*A47B 81/00* (2006.01)
*D06F 39/14* (2006.01)

(52) U.S. Cl.
CPC ..... *A47B 81/00* (2013.01); *A47L 15/4251* (2013.01); *D06F 39/14* (2013.01)

(58) Field of Classification Search
CPC ..... A47B 81/00; D06F 37/18; D06F 39/14; A47L 15/4251
USPC ..... 312/228, 257.1, 265.5, 265.6; 68/3 R
See application file for complete search history.

(56) References Cited

U.S. PATENT DOCUMENTS

| | | | | | |
|---|---|---|---|---|---|
| 3,347,609 | A * | 10/1967 | Mann | A47B 47/03 | 126/191 |
| 5,738,462 | A * | 4/1998 | Petersen | F16B 12/22 | 312/140.2 |
| 2003/0057811 | A1* | 3/2003 | Byrne | D06F 39/12 | 312/265.6 |
| 2004/0107738 | A1* | 6/2004 | Kim | D06F 39/12 | 68/3 R |
| 2005/0012439 | A1* | 1/2005 | Kim | D06F 39/12 | 312/228 |
| 2005/0116591 | A1* | 6/2005 | Hwang | D06F 58/04 | 312/265.6 |
| 2005/0179347 | A1* | 8/2005 | Kim | D06F 39/12 | 312/228 |
| 2011/0285262 | A1* | 11/2011 | Heo | D06F 37/20 | 312/237 |
| 2012/0169196 | A1* | 7/2012 | Marchetti | E06B 3/721 | 312/265.6 |
| 2012/0217853 | A1* | 8/2012 | Hunnell | D06F 39/12 | 312/293.2 |

* cited by examiner

*Primary Examiner* — James O Hansen
(74) *Attorney, Agent, or Firm* — KED & Associates, LLP

(57) ABSTRACT

A cabinet defining defines an external appearance of the laundry treatment apparatus. A top is cover located at the top of the cabinet. The top cover is provided at both sides thereof with holder insertion portions respectively and a holder configured to be inserted into each of the holder insertion portions to couple the top cover to the cabinet. The holder includes a base part coupled to an upper end of the cabinet and a holding part located on the base part to prevent the holder insertion portion from being separated from the base part inserted therein. The holding part is inserted into the holder insertion portion and then the top cover is moved rearward to cause the base part to be inserted into the holder insertion portion.

9 Claims, 12 Drawing Sheets

LAUNDRY TREATMENT APPARATUS

CROSS-REFERENCE TO RELATED APPLICATIONS

This application claims the priority benefit of prior U.S. Provisional Patent Application No. 61/892,046 filed on Oct. 17, 2013 and Korean Patent Application No. 10-2014-0132639, filed on Oct. 1, 2014 in the Korean Intellectual Property Office, whose entire disclosures are hereby incorporated by reference.

BACKGROUND DISCLOSURE

1. Field

The present disclosure relates to laundry treatment apparatuses.

2. Background

Generally, laundry treatment apparatuses are apparatuses that remove contaminants from clothes, bed sheets and other items (hereinafter referred to as "laundry") using chemical decomposition of water and detergent, physical action such as friction between water and laundry, and the like.

Such laundry treatment apparatuses are classified into water stream type laundry treatment apparatuses and drum type laundry treatment apparatuses. In the water stream type laundry treatment apparatuses, an upright wash tub is rotated to create an eddy current in wash water therein. Thereby, the water stream type laundry treatment apparatuses wash laundry using friction between laundries, friction between laundry and wash water, and the like.

In the drum type laundry treatment apparatuses, laundry and wash water are introduced into a horizontally laid drum, and the drum is rotated to allow the laundry to be raised by a lifter formed at an inner surface of the drum. The raised laundry is washed by physical shock caused upon tumbling of the laundry.

The wash tub or the drum of the laundry treatment apparatus is rotated for washing and this rotation causes vibration or shock in the laundry treatment apparatus. Thus, there is a risk of a top cover being separated from a cabinet by vibration or shock caused rotation of the wash tub or the drum.

BRIEF DESCRIPTION OF THE DRAWINGS

The embodiments will be described in detail with reference to the following drawings in which like reference numerals refer to like elements wherein.

DETAILED DESCRIPTION

Figure 1:
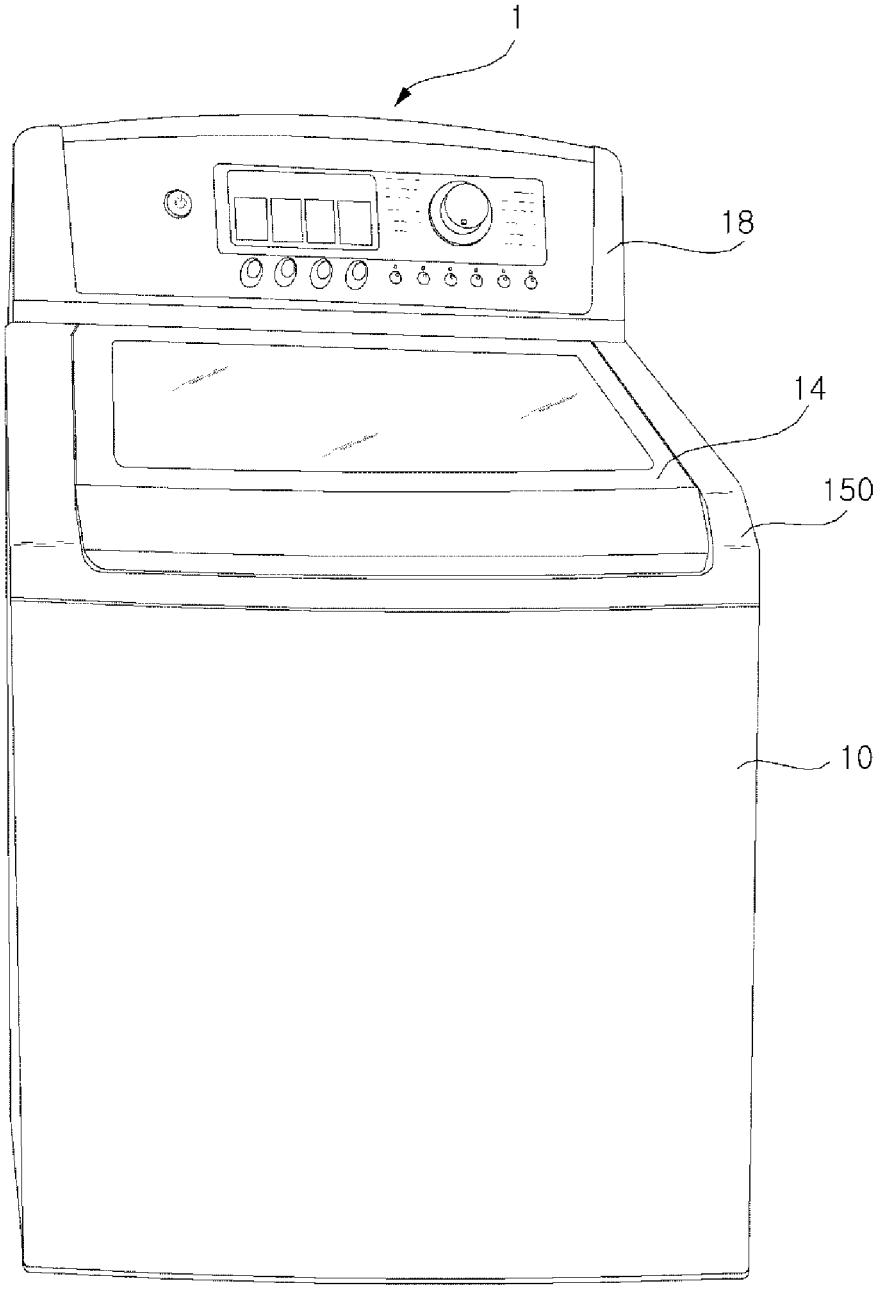
FIG. 1 is a perspective view of a laundry treatment apparatus according to one embodiment of the present disclosure.
Figure 2:
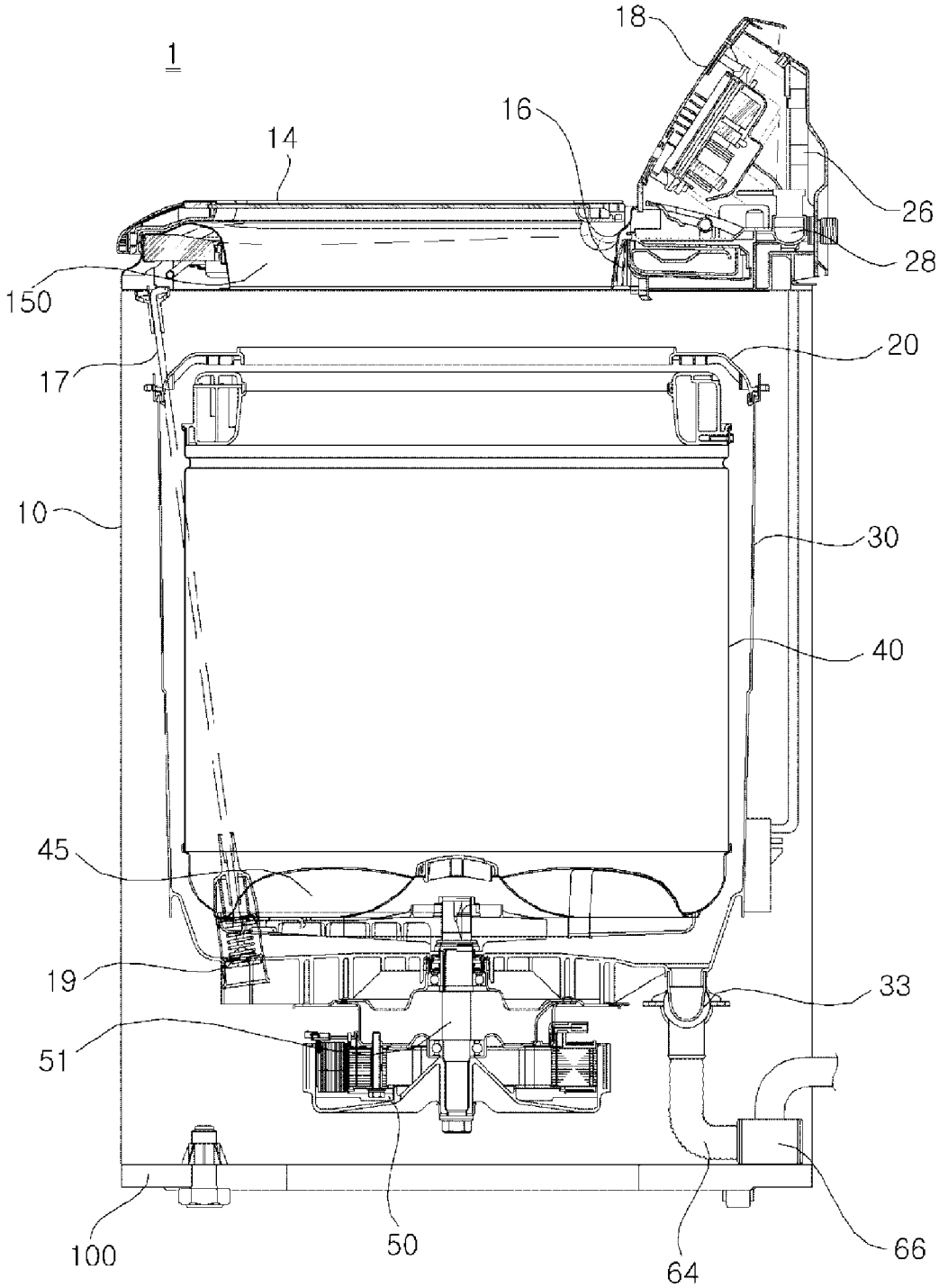
FIG. 2 is a side sectional view of the laundry treatment apparatus according to one embodiment of the present disclosure.

FIG. 1 is a perspective view of a laundry treatment apparatus according to one embodiment of the present disclosure. FIG. 2 is a side sectional view of the laundry treatment apparatus according to one embodiment of the present disclosure.

Referring to FIGS. 1 and 2, the laundry treatment apparatus 1 includes a cabinet 10 defining an external appearance of the laundry treatment apparatus 1, and a top cover 150 located at the top of the cabinet 10 having an opening to allow instruction of laundry. An outer tub 30 is placed within the cabinet 10, and configured to be filled with wash water. An inner tub 40 is placed within the outer tub 30 to provide a space for washing of laundry. A door 14 is rotatably coupled to one side of the top cover 150 to open or close the opening. A base 70 is located at the bottom of the cabinet 10 for installation of a variety of components.

The cabinet 10 has a top opening and incorporates the outer tub 30 in which wash water is received and the inner tub 40 in which laundry is received. A holder 200 (FIG. 3) is mounted to an upper end of the cabinet 10 and serves to couple the top cover 150 to the upper end of the cabinet 10. The base 70 is located under the cabinet 10. The top of the outer tub 30 is open such that wash water supplied through a water supply path 26 is introduced into the outer tub 30 through the open top. The inner tub 40 in which laundry is received is rotated about a vertical shaft within the outer tub 30.

A pulsator 45 is rotatably mounted on a bottom surface of the inner tub 40. The inner tub 40 has a plurality of water holes to enable circulation of wash water between the inner tub 40 and the outer tub 30. Wash water within the inner tub 40 and the outer tub 30 is moved by rotation of the inner tub 40 and/or the pulsator 45, and laundry is washed by action of the resulting water stream, friction between the pulsator 45 and the laundry and the like.

The base 70 is placed under the cabinet 10 to support the cabinet 10. The base 70 incorporates a variety of components including a pump 66.

The top cover 150 is coupled to the upper end of the cabinet 10 via the holder 200. The top cover 150 is centrally provided with the opening through which laundry is introduced into the inner tub 40. The top cover 150 is further provided with a display unit for display of an operational state of the laundry treatment apparatus 1 and a control panel 18 having buttons and the like for input of washing conditions. The display unit, for example, may be a liquid crystal display (LCD) or light emitting diode (LED) unit.

A detergent box 16 for introduction of detergent is installed to an inner rear surface of the top cover 150. The detergent box 16 is connected to the water supply path 26 such that washing additives, such as detergent, fabric softener and/or bleach, stored in the detergent box 16 are introduced, along with water, into the outer tub 30 and the inner tub 40. The door 14 is coupled to the top of the top cover 150.

The door 14 is hinged to the top cover 150 to open or close the laundry introduction opening formed in the top cover 150. The door 14 may be centrally provided with a transparent member that is formed of a transparent material to assist a user in viewing washing of laundry within the inner tub 40. The transparent member preferably has a slightly bulged center portion to cause wash water present on a lower surface of the door 14 to move to an edge of the door 14.

The outer tub 30 placed within the cabinet 10 is suspended from the top cover 150 by a support member 17. A damper 19 is installed to one end of the support member 17 to alleviate vibration generated during operation of the laundry treatment apparatus 1, which assists the support member 17 in stably supporting the outer tub 30 and the inner tub 40.

An outer tub cover 20 having a center opening for introduction and removal of laundry is coupled to the top of the outer tub 30. When the inner tub 40 is rotated at prescribed revolutions per minute or more, a circulating water stream may be created as wash water centrifugally moved upward between the outer tub 30 and the inner tub 40 is guided along a lower surface of the outer tub cover 20 to thereby be resupplied into the inner tub 40.

A motor 50 is mounted under the outer tub 30 and serves to generate torque required to rotate the inner tub 40 and/or the pulsator 45. The torque generated by the motor 50 is transmitted to the inner tub 40 and/or the pulsator 45 via a rotating shaft 51. The laundry treatment apparatus 1 according to one embodiment of the present disclosure is operated in a direct drive manner in which the inner tub 40 and the pulsator 45 are directly coupled to the rotating shaft 51 to directly receive the torque generated by the motor 50. Alternatively, the laundry treatment apparatus 1 may be operated in an indirect drive manner in which the torque of the motor 50 is transmitted to the inner tub 40 and/or the pulsator 45 via power transmission means, such as belts, chains or the like.

In addition, a clutch may be provided to selectively transmit the torque generated by the motor 50 to the inner tub 40 and the pulsator 45. The clutch causes the inner tub 40 and the pulsator 45, which are aligned on the same axis, to selectively come into contact with the rotating shaft 51. Through appropriate clutch operation, only the inner tub 40 may be rotated, only the pulsator 45 may be rotated, or the inner tub 40 and the pulsator 45 may be rotated together.

During operation of the laundry treatment apparatus 1, wash water may be scattered out of the outer tub 30 by action of a water stream generated via rotation of the inner tub 40 and/or the pulsator 45. In this case, a scattering direction of wash water may vary according to a rotation direction of the inner tub 40 and/or the pulsator 45.

Figure 3:
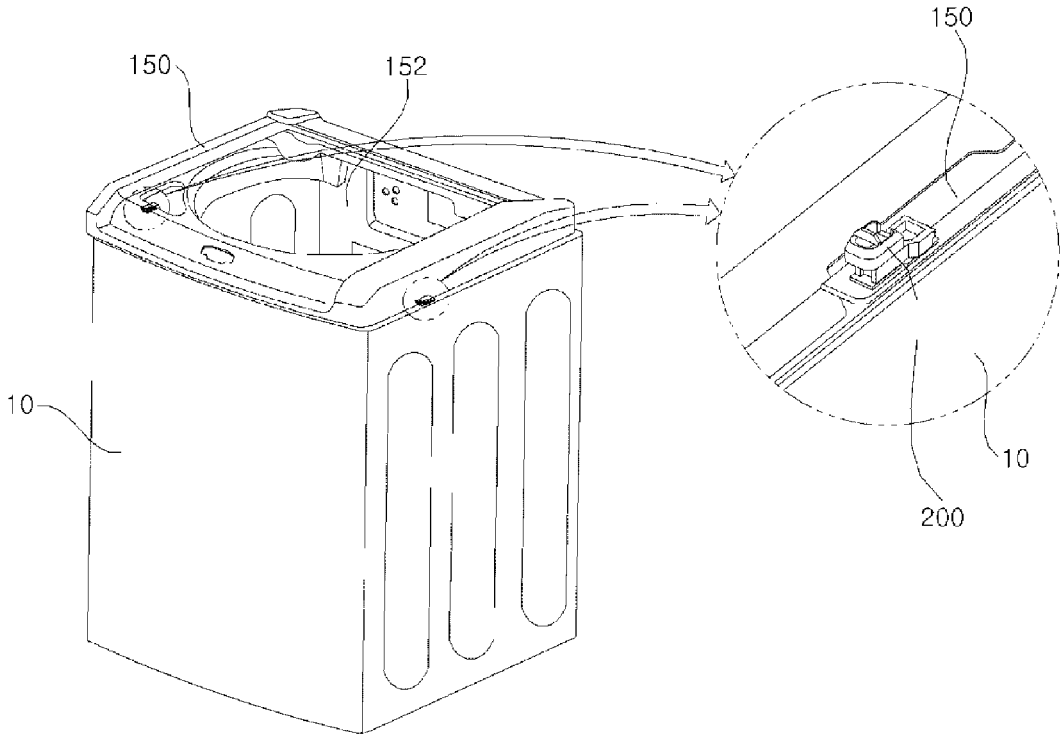
FIG. 3 is a view showing a top cover, coupled to a cabinet, according to one embodiment of the present disclosure.
Figure 4:
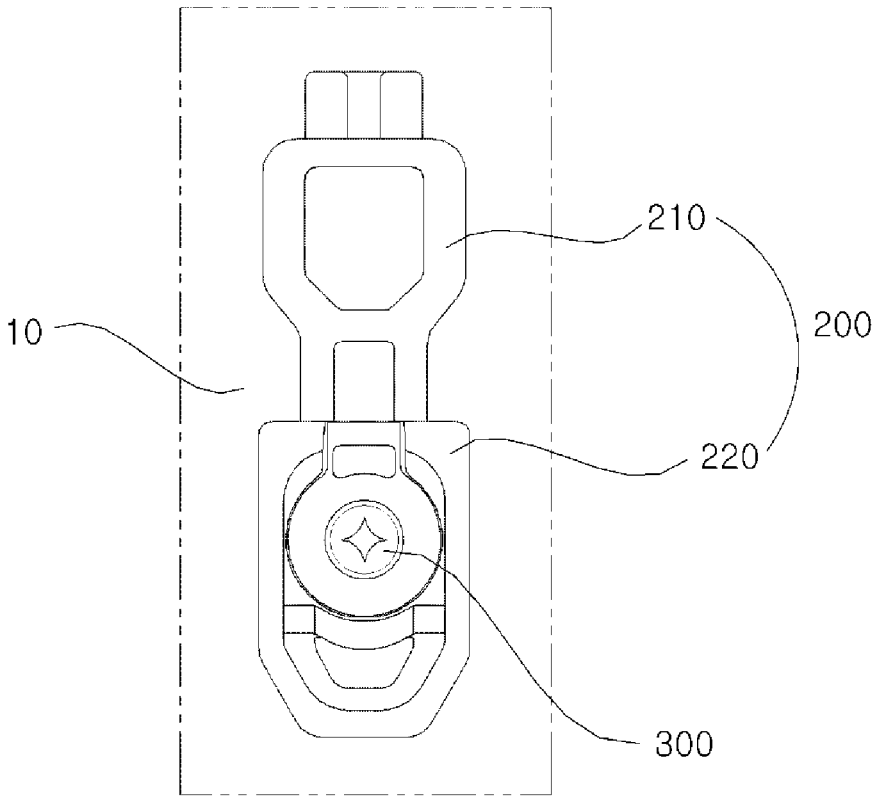
FIG. 4 is a view showing a holder, coupled to a cabinet, according to one embodiment of the present disclosure.
Figure 5A:
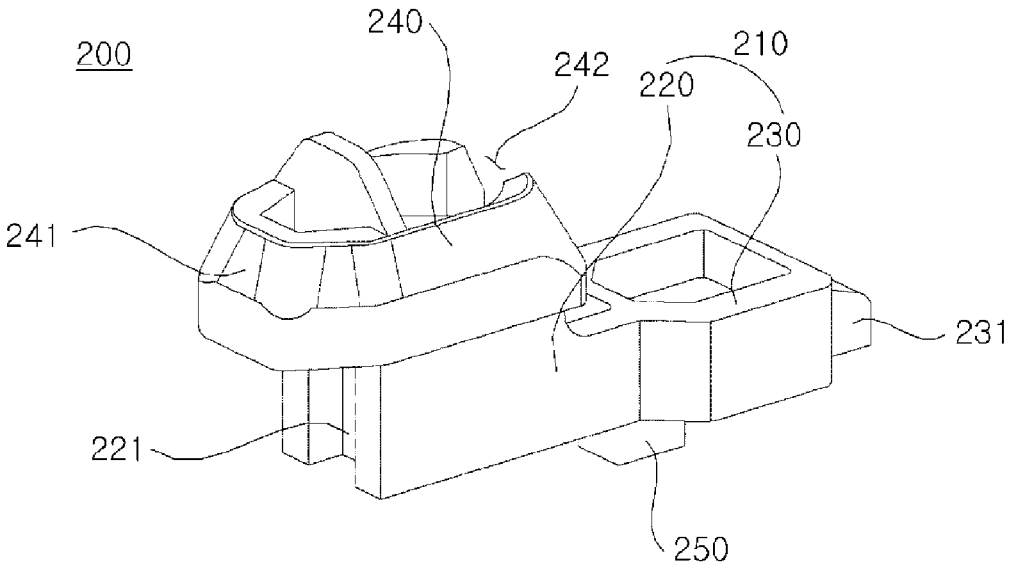
FIG. 5A is a perspective view of the holder according to one embodiment of the present disclosure.
Figure 5B:
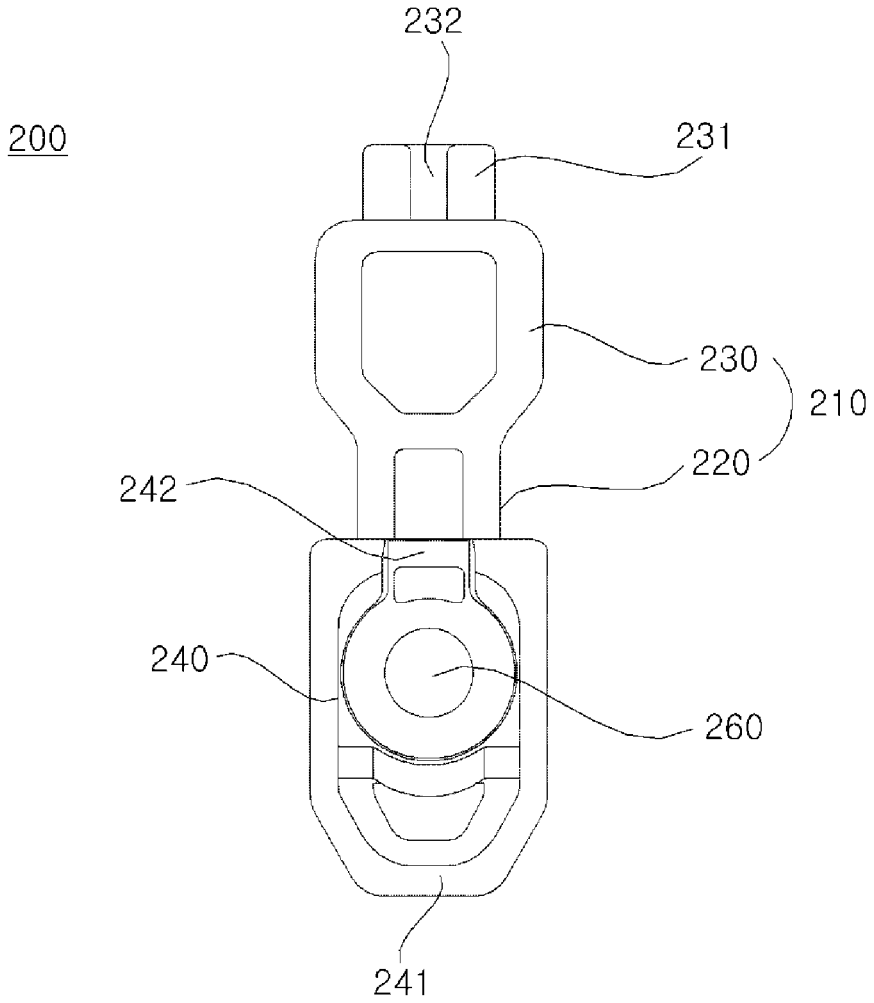
FIG. 5B is a plan view of the holder according to one embodiment of the present disclosure.
Figure 5C:
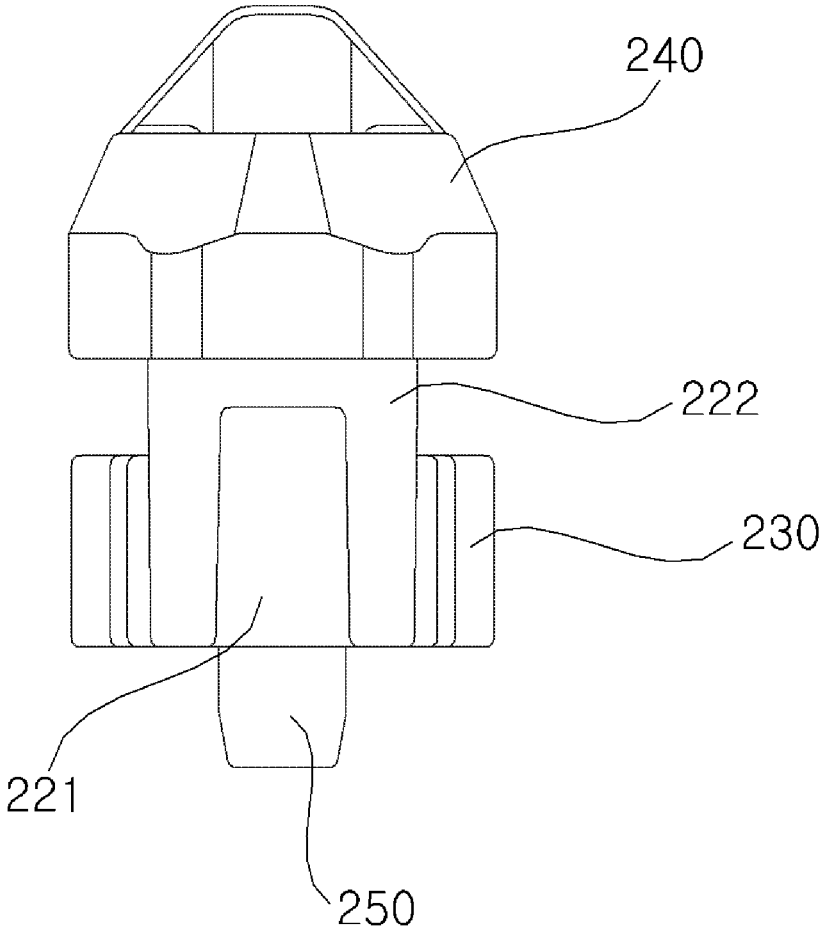
FIG. 5C is a front view of the holder according to one embodiment of the present disclosure.
Figure 5D:
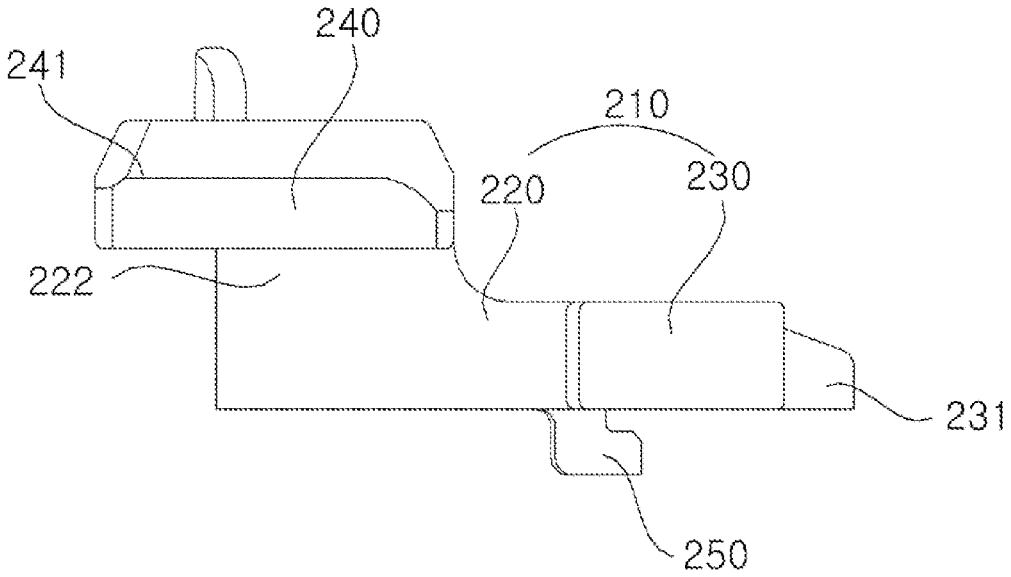
FIG. 5D is a side view of the holder according to one embodiment of the present disclosure.
Figure 6A:
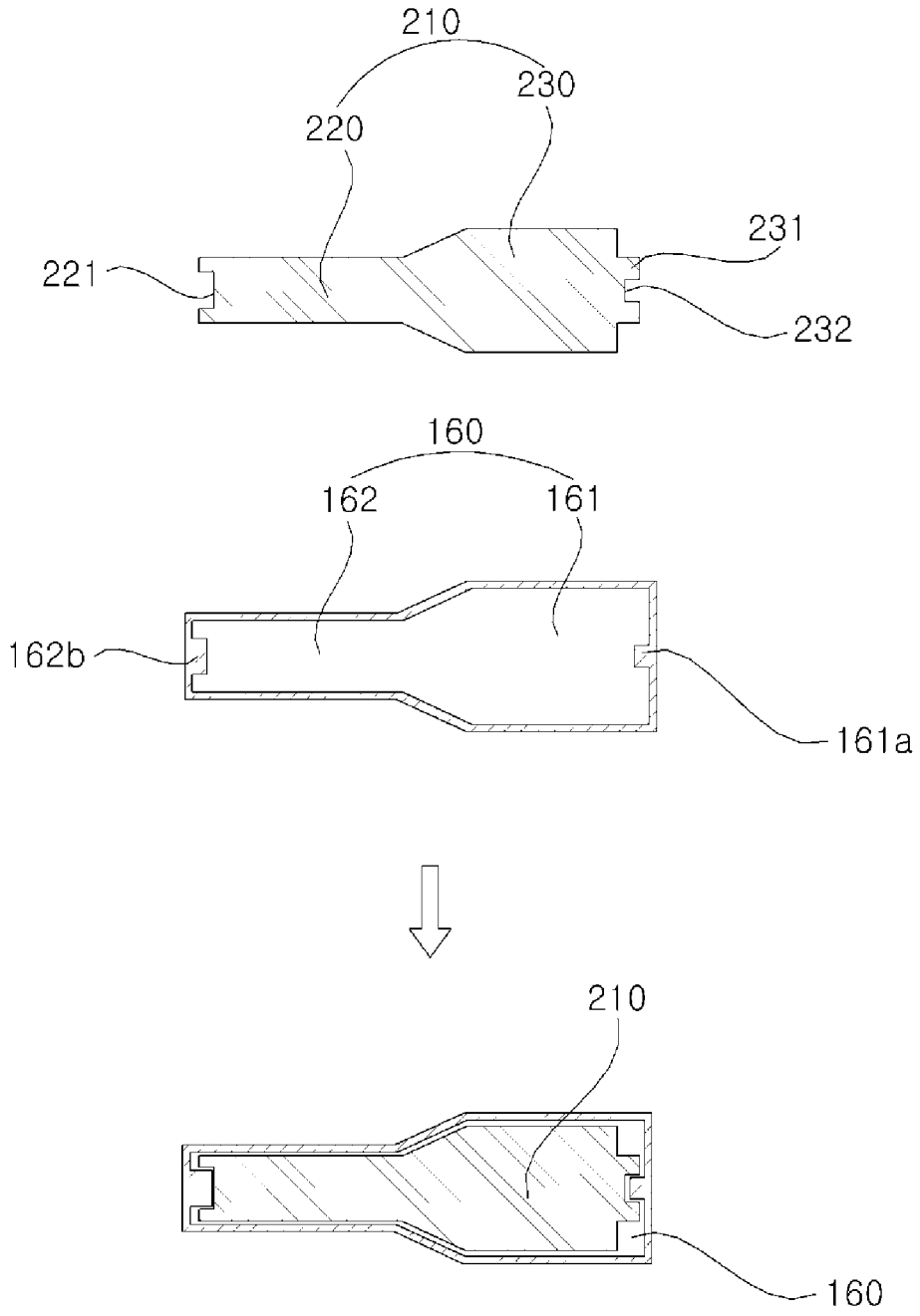
FIG. 6A is a view schematically showing cross sections of a holder insertion portion and a base part according to one embodiment of the present disclosure.
Figure 6B:
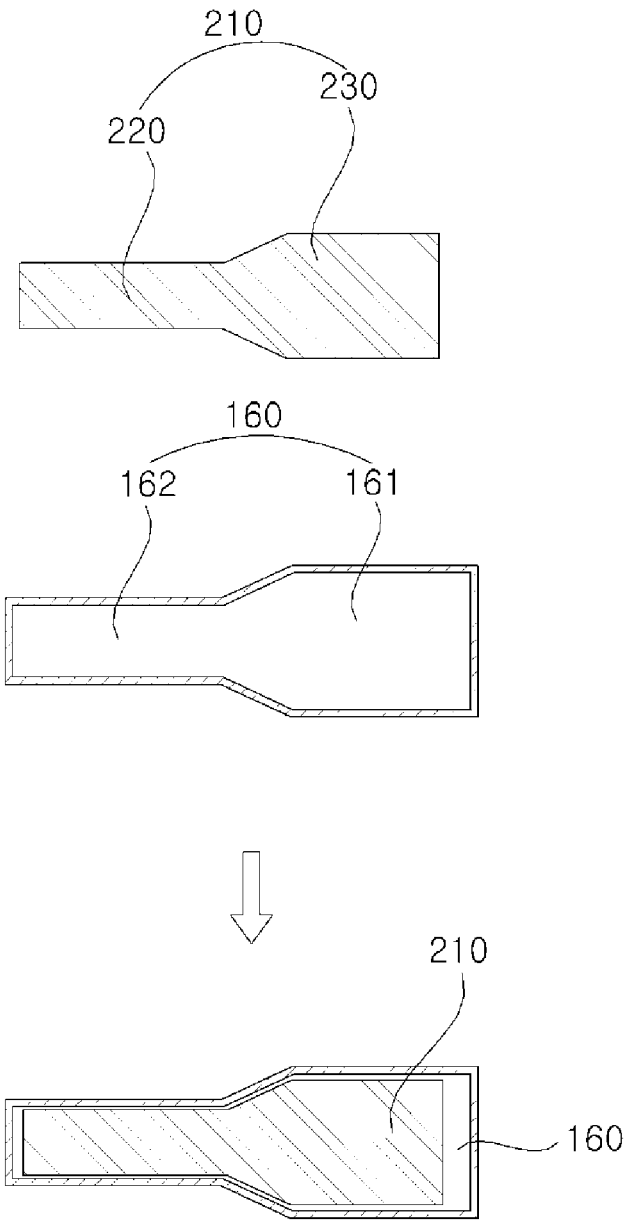
FIG. 6B is a view schematically showing cross sections of a holder insertion portion and a base part according to another embodiment of the present disclosure.

FIG. 3 is a view showing the top cover coupled to the cabinet according to one embodiment of the present disclosure. FIG. 4 is a view showing the holder, coupled to the cabinet, according to one embodiment of the present disclosure. FIG. 5A is a perspective view of the holder according to one embodiment of the present disclosure. FIG. 5B is a plan view of the holder according to one embodiment of the present disclosure. FIG. 5C is a front view of the holder according to one embodiment of the present disclosure. FIG. 5D is a side view of the holder according to one embodiment of the present disclosure. FIG. 6A is a view schematically showing cross sections of a holder insertion portion and a base part according to one embodiment of the present disclosure. FIG. 6B is a view schematically showing cross sections of the holder insertion portion and the base part according to another embodiment of the present disclosure.

Referring to FIGS. 3 to 6A, the cabinet 10 defines an external appearance of the laundry treatment apparatus 1. The top cover 150 is located at the top of the cabinet 10 and is provided at both sides thereof with holder insertion portions 160 (see FIG. 7*b*). The holder 200 is inserted into each of the holder insertion portions 160 to couple the top cover 150 to the cabinet 10. The holder 200 includes a base part 210 coupled to the upper end of the cabinet 10 and a holding part 240 located on the base part 210 to prevent separation of the holder insertion portion 160 from the base part 210 after the base part 210 is inserted into the holder insertion portion 160. The holding part 240 of the holder 200 is first inserted into the holder insertion portion 160 and then the base part 210 is inserted into the holder insertion portion 160 as the top cover 150 is moved rearward.

The holder 200 is coupled to the upper end of the cabinet 10. A pair of holders 200 is respectively coupled to both lateral positions of the upper end of the cabinet 10. Each of the holders 200 is inserted into a corresponding one of the holder insertion portions 160 formed in both lateral sides of the top cover 150 to couple the top cover 150 to the upper end of the cabinet 10. The holder 200 is preferably formed of a highly rigid material to prevent damage to the holder 200 due to vibration generated during operation of the laundry treatment apparatus 1 or external shock.

The holder 200 includes the base part 210 and the holding part 240. The base part 210 and the holding part 240 are integrally formed by injection molding. The holder 200 is provided with a hook 250 and a through-hole 260 through which a fastening member 300 passes to secure the holder 200 to the upper end of the cabinet 10. The through-hole 260 is spaced apart from the hook 250 to prevent the fastening member 300 from interfering with the hook 250. The through-hole 260 is formed at a front position of the holder 200, whereas the hook 250 is formed at a rear position of the holder 200 to secure the holder 200 to the upper end of the cabinet 10.

The base part 210 is a lower part of the holder 200 and is coupled to the upper end of the cabinet 10. The base part 210 is elongated in a longitudinal direction thereof to increase coupling force between the top cover 150 and the cabinet 10. The base part 210 includes a front portion 220 and a rear portion 230 and a width of the front portion 220 is less than a width of the rear portion 230. In addition, the width of the front portion 220 is less than a width of the holding part 240 located on the base part 210. This configuration may prevent the holder insertion portion 160 from being separated from the base part 210 inserted therein due to vibration generated during operation of the laundry treatment apparatus 1 or external shock. In addition, the front portion 220 and the rear portion 230 of the base part 210 are connected to each other, and a connection region between the front and rear portions 220 and 230 having different widths is rounded.

The front portion 220 of the base part 210 has an upwardly extending portion connected to the bottom of the holding part 240 located on the base part 210. The upwardly extending portion of the front portion 220 connected to the bottom of the holding part 240 is referred to as a connection portion 222. The connection portion 222 has the same width as the width of the front portion 220 and a greater height than a thickness of the holder insertion portion 160. As such, when the top cover 150 is moved rearward after the holding part 240 is inserted into a first insertion portion 161 of the holder insertion portion 160 that will be described below, the connection portion 222 is inserted into a second insertion portion 162. Then, when the top cover 150 is further moved to a position where insertion of the base part 210 into the holder insertion portion 160 is possible, the holder insertion portion 160 is lowered by gravity, thus causing the base part 210 to be inserted thereinto.

The front portion 220 of the base part 210 is provided with a second groove 221 for insertion of a second protrusion 162*a* that will be described below. The rear portion 230 of the base part 210 is provided with a first groove 232 for insertion of a first protrusion 161*a* that will be described below. In addition, the base part 210 may have a shape corresponding to a shape of the holder insertion portion 160. Once the base part 210 is inserted into the holder insertion portion 160, the top cover 150 may be prevented from front-and-rear movement and left-and-right movement.

The front portion 220 and the rear portion 230 of the base part 210 are connected to each other. The width of the rear portion 230 is greater than the width of the front portion 220 and equal to the width of the holding part 240. In addition, to enable insertion of the rear portion 230 into the first insertion portion 161 of the holder insertion portion 160 that will be described below, the width of the rear portion 230 is equal to or less than a width of the first insertion portion 161. In some embodiments, the rear portion 230 of the base part 210 may have a rearwardly protruding portion 231. The first groove 232 may be formed in the rearwardly protruding portion 231.

Referring to FIG. 6B, in another embodiment of the present disclosure, the first protrusion 161*a* and the second protrusion 162*a* of the holder insertion portion 160 and the first groove 232 and the second groove 221 of the base part 210 may be omitted.

The base part 210 is provided at a lower surface thereof with the downwardly protruding hook 250. The hook 250 is inserted into a hook hole (not shown) formed in the upper end of the cabinet 10 that will be described below. As such, the holder 200 may be secured to the upper end of the cabinet 10 via the hook 250 and the fastening member 300. As described above, the hook 250 is preferably spaced apart from the through-hole 260.

The holding part 240 is located on the front portion 220 of the base part 210 and connected to the connection portion 222 of the front portion 220. The width of the holding part 240 is greater than the width of the front portion 220 and the width of the second insertion portion 160 that will be described below. This may prevent upward separation of the holder insertion portion 160 from the base part 210. In addition, the width of the holding part 240 may be equal to or less than the width of the first insertion portion 161 to allow the holding part 240 to be inserted into the first insertion portion 161.

The holding part 240 has a forwardly protruding portion 241 to prevent separation of the holder insertion portion 160 from the base part 210. In addition, the holding part 240 has a guide groove 242 formed in a rear surface thereof to downwardly guide the first protrusion 161*a* when the holding part 240 is inserted into the first insertion portion 161. This may prevent the first protrusion 161*a* from interfering with the holding part 240 when the holding part 240 is inserted into the first insertion portion 161. It will be appreciated with reference to FIG. 6B that the holder insertion portion may have no first protrusion 161*a* and the holding part 240 may have no guide groove 242 in another embodiment of the present disclosure.

The holding part 240 has an outwardly tapered top surface. This may ensure that the holding part 240 is smoothly inserted into the first insertion portion 161 of the holder insertion portion 160 even at a slightly deviated position.

The top cover 150 is provided at both sides thereof with the holder insertion portions 160 for insertion of the holders 200. As described above, the holder insertion portion 160 has a shape corresponding to a shape of the base part 210.

The holder insertion portion 160 includes the first insertion portion 161 that has a greater width than the width of the holding part 240 and the width of the rear portion 230 of the base part 210 and the second insertion portion 162 that is connected to the first insertion portion 161 and has a greater width than the width of the front portion 220 of the base part 210. Note that the second insertion portion 162 has a smaller width than the width of the holding part 240.

The first insertion portion 161 is provided with the first protrusion 161*a* to be inserted into the first groove 232 of the rear portion 230, and the second insertion portion 162 is provided with the second protrusion 162*a* to be inserted into the second groove 221 of the front portion 220. As such, when the base part 210 is inserted into the holder insertion portion 160, the first protrusion 161*a* is inserted into the first groove 232 and the second protrusion 162*a* is inserted into the second groove 221. This may further increase coupling force between the top cover 150 and the cabinet 10.

The fastening member 300 is configured to pass through the through-hole 260 formed in the holder 200 to secure the holder 200 to the upper end of the cabinet 10. The fastening member 300 may be a bolt.

A procedure of coupling the top cover 150 to the cabinet 10 of the laundry treatment apparatus 1 having the above-described configuration according to the present disclosure will be described in reference to FIGS. 7A and 7B.

Figure 7A:
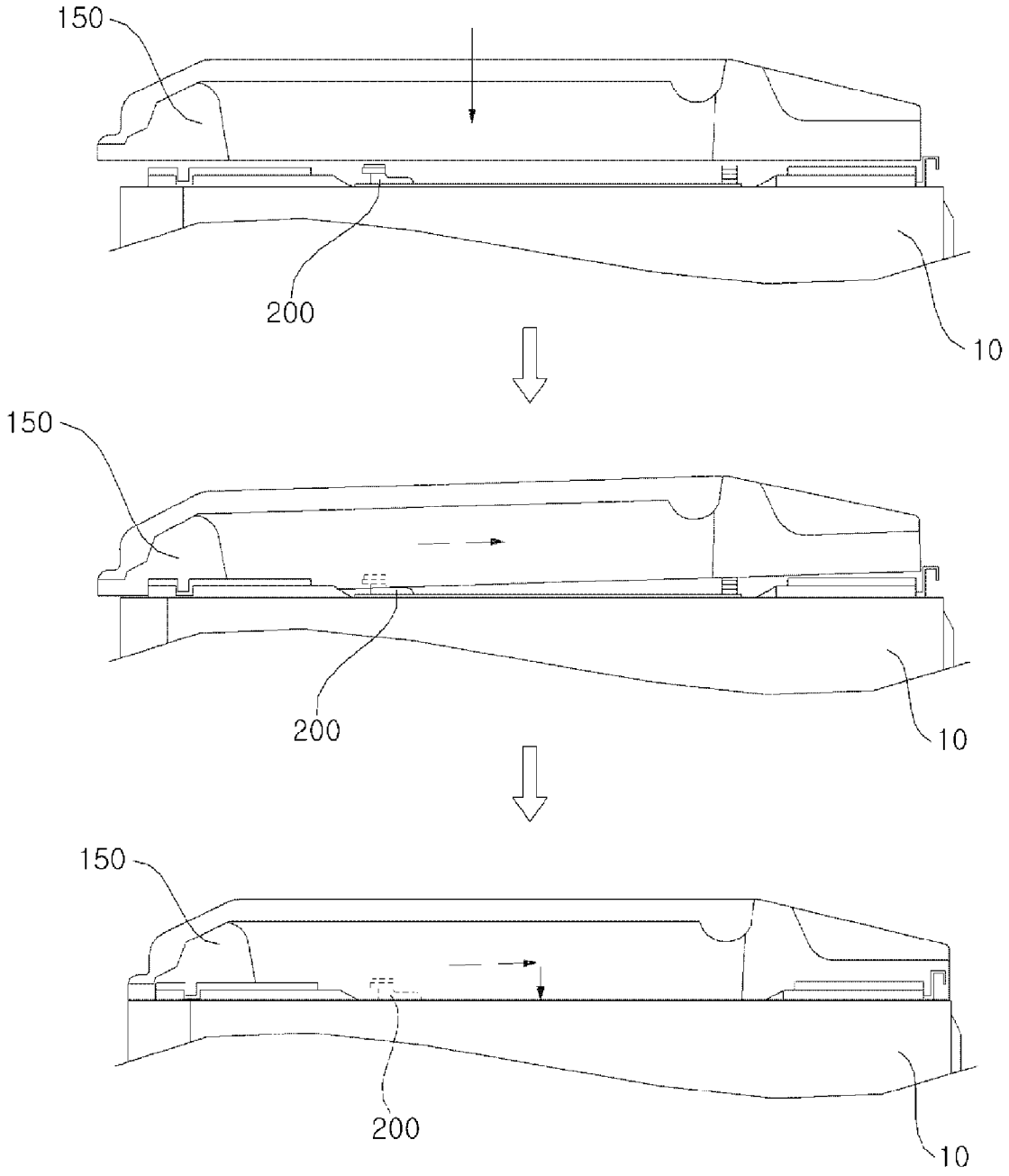
FIGS. 7A and 7B are views showing a procedure of coupling the top cover to the cabinet according to one embodiment of the present disclosure.
Figure 7B:
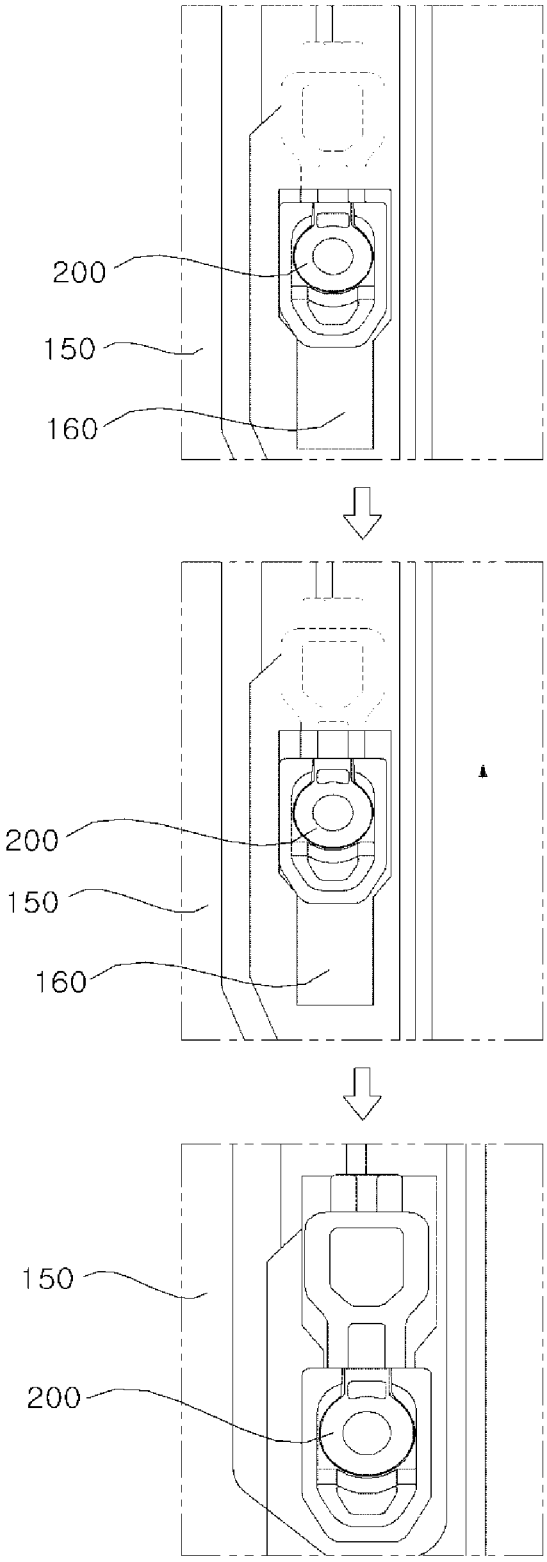

Referring to FIGS. 7A and 7B, the top cover 150 according to one embodiment of the present disclosure is located at the top of the cabinet 10 to enable insertion of the holder 200 into the holder insertion portion 160 of the top cover 150.

After the first insertion portion 161 of the holder insertion portion 160 is positioned above the holding part 240, the holding part 240 is inserted into the first insertion portion 161. In this case, as the first protrusion 161*a* formed at the first insertion portion 161 is inserted into the guide groove 242 formed in the holding part 240, the holding part 240 may be inserted into the first insertion portion 161 without interference.

When the top cover 150 is moved rearward in a state in which the holding part 240 is inserted into the first insertion portion 161, the connection portion 222 is inserted into the second insertion portion 162. When the top cover 150 is further moved rearward until a shape of the holder insertion portion 160 corresponds to a shape of the base part 210, the holder insertion portion 160 is lowered by gravity, thus causing the base part 210 to be inserted into the holder insertion portion 160. Upon insertion of the base part 210 into the holder insertion portion 160, the first protrusion 161*a* and the second protrusion 162*a* of the holder insertion portion 160 are inserted into the first groove 232 and the second groove 221. Once the base part 210 is inserted into the holder insertion portion 160, the base part 210 prevents front-and-rear movement and left-and-right movement of the holder insertion portion 160 and the holding part 240 prevents up-and-down movement of the holding part 240 even when vibration or shock is applied to the laundry treatment apparatus 1, which may prevent the top cover 150 from being easily separated from the cabinet 1.

In this way, a method of coupling the top cover 150 to the cabinet 10 includes a first insertion step of inserting the holding part 240 into the first insertion portion 161 of the top cover 150 and a second insertion step of rearwardly moving the top cover 150 after insertion of the holding part 240 into the first insertion portion 161 to insert the base part 210 into the holder insertion portion 160. That is, the top cover 150 is coupled to the holder 200 stepwise.

As is apparent from the above description, a laundry treatment apparatus of the present disclosure has one or more effects as follows. First, it is possible to prevent a top cover from being easily separated from a cabinet even when shock or vibration is applied to the laundry treatment apparatus. Second, the top cover may be easily assembled and secured to the cabinet. Third, easy assembly of the top cover and the cabinet may improve productivity.

Therefore, the present disclosure has been made in view of the above problems, and it is one object of the present disclosure to provide a laundry treatment apparatus in which a top cover is not easily separated from a cabinet even when shock or vibration is applied to the laundry treatment apparatus.

It is another object of the present disclosure is to provide a laundry treatment apparatus in which a top cover may be easily assembled and secured to a cabinet.

In accordance with an embodiment of the present disclosure, the above and other objects can be accomplished by the provision of a laundry treatment apparatus including a cabinet defining an external appearance of the laundry treatment apparatus, a top cover located at the top of the cabinet, the top cover being provided at both sides thereof with holder insertion portions respectively and a holder configured to be inserted into each of the holder insertion portions to couple the top cover to the cabinet, wherein the holder includes a base part coupled to an upper end of the cabinet and a holding part located on the base part to prevent the holder insertion portion from being separated from the base part inserted therein, and wherein the holding part is inserted into the holder insertion portion and then the top cover is moved rearward to cause the base part to be inserted into the holder insertion portion.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treatment apparatus comprising:

a cabinet;

a top cover located at the top of the cabinet, the top cover being provided at both sides thereof with holder insertion portions respectively; and a holder configured to be inserted into each of the holder insertion portions to couple the top cover to the cabinet, the holder having a base part coupled to an upper end of the cabinet, and a holding part located on the base part to prevent the holder insertion portion from being separated from the base part inserted therein, wherein the holding part is inserted into the holder insertion portion and when the top cover is moved rearward, the base part is inserted into the holder insertion portion, wherein the base part includes a first portion forming one side of the base part and a second portion forming the other side of the base part, and a width of the first portion is less than a width of the second portion, and the holding part has a greater width than the width of the first portion of the base part, wherein the holder insertion portion has a shape corresponding to a shape of the base part, and wherein the holder insertion portion includes:

a first insertion portion having a width greater than the width of the holding part and the width of the second portion of the base part;

a second insertion portion connected to the first insertion portion, the second insertion portion having a width greater than the width of the first portion of the base part.

2. The apparatus according to claim 1, wherein the width of the holding part is equal to the width of the second portion of the base part.

3. The apparatus according to claim 1, wherein the second insertion portion has a rearwardly protruding second protrusion and the first portion of the base part has a second groove for insertion of the second protrusion.

4. The apparatus according to claim 1, wherein the first insertion portion has a forwardly protruding first protrusion, and the second portion of the base part has a first groove for insertion of the first protrusion.

5. The apparatus according to claim 4, wherein the holding part has a guide groove configured to downwardly guide the first protrusion when the holding part is inserted into the first insertion portion.

6. The apparatus according to claim 1, wherein the base part has a downwardly protruding hook formed at a lower surface thereof, and the cabinet has a hook hole for insertion of the hook.

7. The apparatus according to claim 1, further comprising a fastening member penetrating the holder to couple the holder to the upper end of the cabinet, and the holder has a through-hole for passage of the fastening member.

8. The apparatus according to claim 1, wherein the first portion of the base part and the second portion of the base part are provided below the holding part and adjacent to each other in the rearward direction.

9. A laundry treatment apparatus comprising;

a cabinet;

a top cover located at the top of the cabinet, the top cover being provided at both sides thereof with holder insertion portions respectively; and a holder configured to be inserted into each of the holder insertion portions to couple the top cover to the cabinet, the holder having a base part coupled to an upper end of the cabinet, and a holding part located on the base part to prevent the holder insertion portion from being separated from the base part inserted therein, wherein the holding part is inserted into the holder insertion portion and when the top cover is moved rearward, the base part is inserted into the holder insertion portion, wherein the base part includes a first portion forming one side of the base part and a second portion forming the other side of the base part, and a width of the first portion is less than a width of the second portion, and the holdin art has a reater width than the width of the first portion of the base part, wherein the holder insertion portion has a shape corresponding to a shape of the base part, wherein the holding part is located on the first portion of the base part, and the first portion has an upwardly extending portion connected to the holding part, and wherein the holding part is not overlapped with the second portion.

* * * * *